US011024281B2

(12) United States Patent
Kalinichenko

(10) Patent No.: US 11,024,281 B2
(45) Date of Patent: Jun. 1, 2021

(54) METHOD AND DEVICE FOR SUPPRESSING ACOUSTIC INTERFERENCE SIGNALS RESULTING FROM THE OPERATION OF A MOTOR-VEHICLE DRIVE UNIT

(71) Applicant: ASK INDUSTRIES GMBH, Niederwinkling (DE)

(72) Inventor: Victor Kalinichenko, Viechtach (DE)

(73) Assignee: ASK INDUSTRIES GMBH, Niederwinkling (DE)

( * ) Notice: Subject to any disclaimer, the term of this patent is extended or adjusted under 35 U.S.C. 154(b) by 0 days.

(21) Appl. No.: 16/343,944

(22) PCT Filed: Oct. 20, 2017

(86) PCT No.: PCT/EP2017/076890
§ 371 (c)(1),
(2) Date: Apr. 22, 2019

(87) PCT Pub. No.: WO2018/073431
PCT Pub. Date: Apr. 26, 2018

(65) Prior Publication Data

US 2019/0244599 A1 Aug. 8, 2019

(30) Foreign Application Priority Data

Oct. 20, 2016 (DE) ..... 102016120038.7

(51) Int. Cl.
*G10K 11/178* (2006.01)

(52) U.S. Cl.
CPC .... *G10K 11/1781* (2018.01); *G10K 11/17817* (2018.01); *G10K 11/17875* (2018.01); *G10K 2210/1282* (2013.01)

(58) Field of Classification Search
CPC combination set(s) only.
See application file for complete search history.

(56) References Cited

U.S. PATENT DOCUMENTS

2003/0187527 A1* 10/2003 Delchar ..... G10K 11/17823 700/94
2007/0188308 A1* 8/2007 Lavoie ..... H03G 3/32 340/425.5

(Continued)

FOREIGN PATENT DOCUMENTS

JP H05124476 A1 5/1993

*Primary Examiner* — Duc Nguyen
*Assistant Examiner* — Assad Mohammed
(74) *Attorney, Agent, or Firm* — Rimôn, P.C.

(57) ABSTRACT

Method for suppressing acoustic interfering signals, introduced into a passenger compartment of the motor vehicle, including: detecting a physical size in the passenger compartment of the motor vehicle, generating a detection information describing the detected physical size in the passenger compartment of the motor vehicle, selection of a counter-signal parameter influencing the acoustic counter-signal, depending upon the physical size described through the detection information, and/or adaptation of a counter-signal parameter influencing the acoustic counter-signal, depending upon the physical size described through the detection information, generating an acoustic counter-signal on the basis of the selected counter-signal parameter and/or on the basis of the adapted counter-signal parameter, and outputting the generated acoustic counter-signal into the passenger compartment of the motor vehicle to suppress acoustic interfering signals, introduced into the passenger compartment of the motor vehicle, resulting from the operation of the on-board drive unit.

19 Claims, 1 Drawing Sheet

(56) References Cited

U.S. PATENT DOCUMENTS

| | | | | |
|---|---|---|---|---|
| 2009/0058633 | A1* | 3/2009 | Luo | G10K 11/17854 340/538.12 |
| 2013/0108067 | A1 | 5/2013 | Schumacher et al. | |
| 2015/0086035 | A1* | 3/2015 | Shin | B60R 11/0217 381/86 |
| 2015/0228267 | A1* | 8/2015 | Inoue | G10K 11/17821 381/71.4 |
| 2015/0249886 | A1* | 9/2015 | Haylett | G10K 11/17857 381/71.4 |
| 2016/0167478 | A1* | 6/2016 | Lee | B60H 1/00828 165/203 |

* cited by examiner

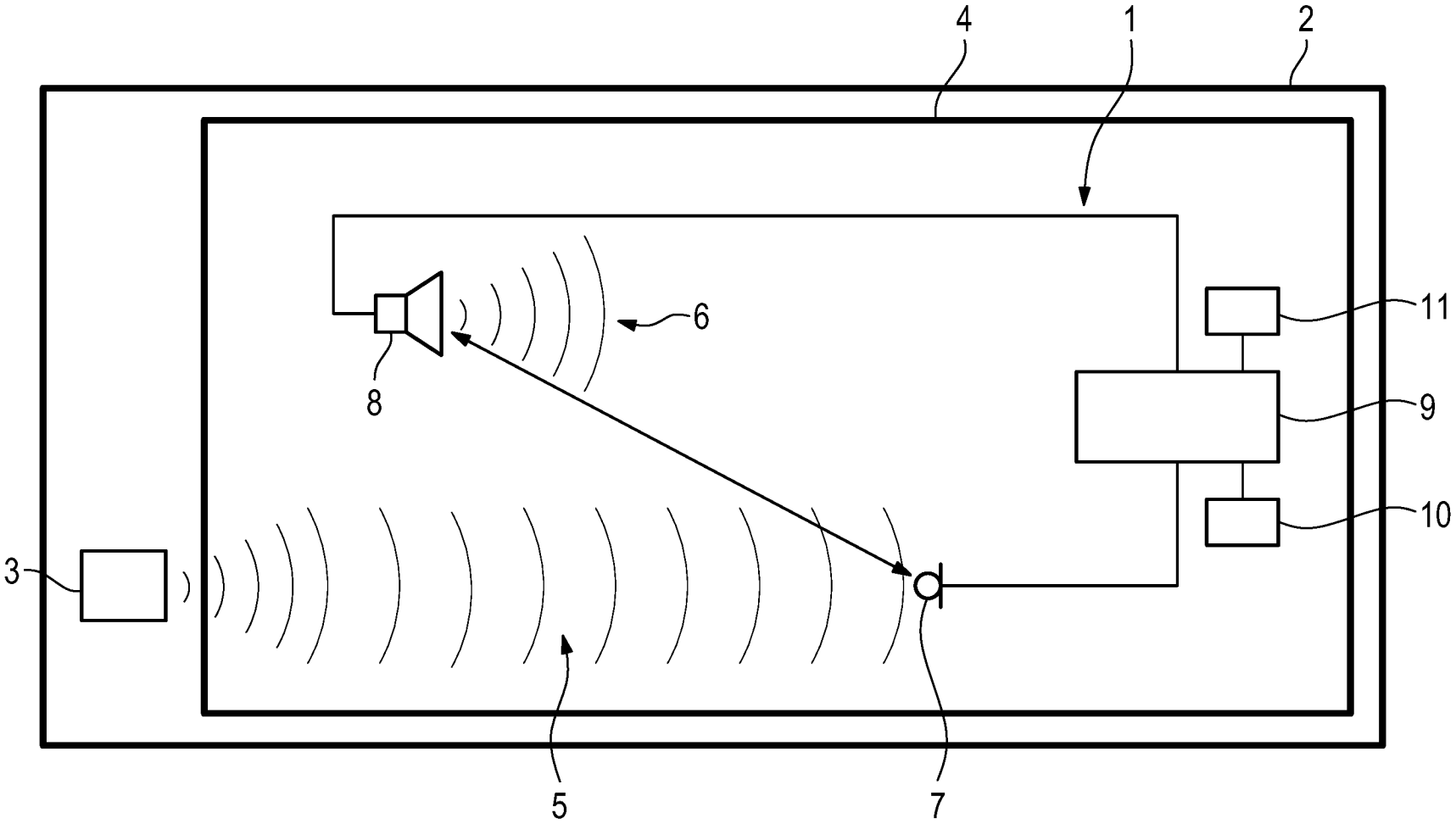
11
9
10
2
1
4
7
6
5
8
3

METHOD AND DEVICE FOR SUPPRESSING ACOUSTIC INTERFERENCE SIGNALS RESULTING FROM THE OPERATION OF A MOTOR-VEHICLE DRIVE UNIT

The invention relates to a method for the suppressing of acoustic interfering signals, introduced into a passenger compartment of the motor vehicle, resulting from the operation of an on-board drive unit, by means of at least one artificially-generated acoustic counter-signal, defined through at least one counter-signal parameter.

Corresponding methods are known in principle under the designation "Engine Order Cancellation" from the field of motor vehicle audio technology. The target of corresponding methods is always an as complete as possible suppression of acoustic interfering signals, introduced into the passenger compartment of the motor vehicle, resulting from the operation of an on-board drive unit. Corresponding interfering signals can, e.g., be vibrations. The principle of corresponding methods rests on detecting an acoustic interfering signal by means of suitable sensors and, on the basis of the detected acoustic interfering signal, generating an acoustic counter-signal and introducing said signal into the passenger compartment by means of a suitable output device. The acoustic counter-signal effects, in particular due to a phase reverse to the phase of the acoustic interfering signal, an, if necessary, complete suppression of the acoustic interfering signal.

The suppression, possible by means of corresponding methods, of corresponding acoustic interfering signals, is, inter alia, significantly dependent upon the physical conditions prevalent in the passenger compartment. The physical conditions prevalent in the passenger compartment can e.g. bear considerable influence on the sound dispersion speed, which can negatively affect the detection of acoustic interfering signals or the generation of acoustic counter-signals, and therefore can have a non-optimal suppression of the acoustic interfering signals as a result.

The object underlying the invention is to specify a method for suppressing acoustic interfering signals, introduced into a passenger compartment of the motor vehicle, resulting from the operation of an on-board drive unit, by means of at least one artificially generated acoustic counter-signal, defined through at least one counter-signal parameter, which method is improved in particular with respect to the suppression of acoustic interfering signals under different physical conditions in a passenger compartment.

The object is achieved by a method according to claim 1. The dependent method claims concern possible embodiments of the method. The object is further achieved by a device according to claim 10. The dependent device claims concern possible embodiments of the device.

The herein-described method serves to suppress acoustic interfering signals, introduced into a passenger compartment of the motor vehicle, resulting from the operation of an on-board drive unit, i.e. in particular vibrations, by means of at least one artificially-generated acoustic counter-signal, defined through at least one counter-signal parameter. The method thus makes an acoustic suppression or damping of corresponding acoustic interfering signals, hereinafter briefly referred to as interfering signals, through the generation of artificial acoustic counter-signals, hereinafter briefly referred to as counter-signals. Essentially, interfering signals are, within the scope of the method, detected by means of a suitable sensor, and counter-signals are generated on the basis of the detected interfering signals and are output into the passenger compartment. The counter-signals effect an, if necessary, complete suppression of the interfering signals, in particular on the basis of a phase set reversely to a phase of the respective interfering signal.

The method includes the steps further described in the following:

In a first step of the method, at least one physical size, under which a value or value range of an established physical size, i.e. e.g. a pressure, moisture, or temperature value, is also certainly to be understood, is detected in the passenger compartment of the motor vehicle. The physical size can also e.g. relate to the pressure, the moisture, or the temperature in the or inside the passenger compartment. Multiple (different) physical sizes can certainly be detected. In all cases, the detection of the respective physical sizes makes a more or less complete representation of the physical, if necessary, climatic conditions in the passenger compartment possible, depending upon the number of detected physical sizes. The detection of respective physical sizes results by means of a suitable on-board detection device, which, with regards to the respective physical sizes to be detected, is equipped with suitable detection elements, in particular arranged or configured inside the passenger compartment. Corresponding detection elements can e.g. relate to pressure, moisture or temperature sensors.

In a second step of the method, a detection information is generated describing at least one detected physical size in the passenger compartment of the motor vehicle. The detected physical size(s) or values are, accordingly thereto, represented, in a detection information, (further) processable data-accordantly. The generation of the detection information can occur in the detection device.

In a third step of the method, at least one acoustic counter-signal parameter, influencing the counter-signal, in the following briefly referenced as counter-signal parameter, is selected depending upon the physical size(s) described through the detection information. The selection typically occurs from a storage device, which contains multiple counter-signal parameters, or in which multiple counter-signal parameters are stored data-accordantly. Respectively, at least one established physical size or counter-signal parameter of an established value or value range of an established physical size are stored in the storage device; respective counter-signal parameters are accordingly stored in particular linked with an established physical size or an established value or value range of an established physical size. The selection of a corresponding counter-signal parameter occurs on the basis of the physical size described through the detection information, wherein a counter-signal parameter, the assigned physical size of which corresponds to the physical size described through the detection information, is selected. To that end, suitable selection algorithms can be employed. The storage device can, in this respect, be configured as a look-up table.

The assigning of respective counter-signal parameters to respective physical sizes can result based on assignment criteria gained from corresponding preliminary investigations, in which the influence of different physical parameters in the passenger compartment on the suppression of corresponding interfering signals in the passenger compartment was examined. In practice, e.g. transfer paths can be measured as examples for corresponding counter-signal parameters, e.g. for different temperatures, and can then be stored in the storage device, linked with the respective temperature.

Alternatively or additionally, at least one, in particular pre-selected counter-signal parameter, influencing the counter-signal, is adapted or changed, depending upon the physical size described through the detection information, in the third step of the method. The adaptation of the, in particular pre-selected, counter-signal parameter can occur by means of an adaptation function or adaptation provision, i.e. generally an adaptation algorithm, selected depending upon the physical size described through the detection information. The adaptation function can e.g. contain an interpolation or an extrapolation of a respective counter-signal parameter with respect to an established target size. The selection of an adaptation function can result depending upon the physical size described through the detection information, typically from a storage device containing multiple adaptation functions, which device contains multiple adaptation functions, or in which multiple counter-signal parameters are filed data-accordantly. In particular, at least one established physical size or an established value or value range of an adaptation function assigned to an established physical size, respectively, are stored; respective adaptation functions are accordingly stored in particular linked with an established physical size or an established value or value range of an established physical size. The selection of a corresponding adaptation function results on the basis of the physical size described through the detection information, wherein an adaptation function, the assigned physical size or value of which corresponds to the physical size described through the detection information, is selected. To that end, suitable selection algorithms can, in turn, be employed. The storage device can, in this respect, in turn be configured as a look-up table. The assignment of respective adaptation functions to respective physical sizes can, in turn, result based on assignment criteria obtained from corresponding preliminary investigations, in which the influence of different physical parameters in the passenger compartment on the suppression of corresponding interfering signals in the passenger compartment was examined.

Via an adaptation function, EOC parameters or EOC tuning parameters, e.g. A (forgetting factor) or μ (step width) can also be adapted. In other words, an adaptation of EOC parameters or EOC tuning parameters can occur by means an adaptation function selected depending upon the physical size described through the detection information. The EOC parameters or EOC tuning parameters influence corresponding counter-signal parameters, thus an adaptation of counter-signal parameters can result via an adaptation of EOC parameters or EOC tuning parameters.

In all cases, a corresponding counter-signal parameter can relate e.g. to the phase of the counter-signal or the frequency of the counter-signal or a transfer path describing the phase and the frequency of the counter-signal or the intensity of the counter-signal. Thus, the phase of the counter-signal or the frequency of the counter-signal or a transfer path describing the phase and the frequency of the counter-signal, which typically refers to an actual spatial arrangement of a sensor for detecting a corresponding interfering signal relative to an outputting device for outputting a corresponding counter-signal, or vice versa, or the intensity of the counter-signal, can be used. In the third step of the method, e.g. a corresponding transfer path can accordingly be selected or adapted depending upon the physical size described through the detection information.

In a fourth step of the method, a counter-signal is generated on the basis of the at least one selected counter-signal parameter and/or on the basis of the at least one adapted counter-signal parameter. The generation of the counter-signal or the acoustic features thereof rests or rest accordingly on the one hand on the interfering signal to be suppressed, and on the other hand—due to a corresponding selection or adaptation of at least one counter-signal parameter—on the physical conditions in the passenger compartment at least partially represented through respectively detected physical sizes.

In a fifth step of the method, the generated counter-signal is output into the passenger compartment of the motor vehicle for suppressing interfering signals, introduced into the passenger compartment of the motor vehicle, resulting from the operation of the on-board drive unit. The outputting occurs by means of a suitable outputting device, arranged or configured in particular in the passenger compartment. The output device can, e.g., be configured as a speaker device, or at least include such device.

In total, a method, improved in particular with respect to the suppression of acoustic interfering signals under different physical conditions in a passenger compartment, for suppressing interfering signals introduced into a passenger compartment of the motor vehicle, resulting from the operation of an on-board drive unit, by means of at least one artificially generated counter-signal defined through at least one counter-signal parameter, is thus present.

It is certainly also possible within the scope of the method that a course of the at least one physical size, time-dependent over a certain time period, i.e. e.g. a time period of 10, 30, 60 seconds, is detected. Thus, possible (temporal) changes of the physical size or of the physical conditions in the passenger compartment can be detected and can be included in the selection or adaptation of respective counter-signal parameters.

Similarly, it is possible within the scope of the method that the at least one physical size is continuously or discontinuously detected, i.e. e.g. in established regular or irregular (temporal) intervals.

As indicated above, a counter-signal is definable or defined through multiple counter-signal parameters. Within the scope of the selection of the at least one counter-signal parameter influencing the counter-signal, all counter-signal parameters influencing the counter-signal parameters can certainly be selected, so that a completely new counter-signal is selected. Alternatively or additionally, all counter-signal parameters influencing the counter-signal parameter, within the scope of the adaptation of the at least one counter-signal parameter influencing the counter-signal, can be adapted so that a complete counter-signal is adapted.

Aside from the method, the invention also relates to a device for suppressing interfering signals, introduced into a passenger compartment of the motor vehicle, resulting from the operation of an on-board drive unit, by means of an artificially-generated counter-signal, defined through at least one counter-signal parameter, in particular according to a method as described above.

The device in particular includes a detection device, a control unit, a storage device and an outputting device. The detection device is configured in the passenger compartment of a motor vehicle for the detection of at least one physical size, i.e. e.g. the pressure or the moisture or the temperature. The control unit is configured to generate at least one detection information describing the at least one physical size in the passenger compartment of the motor vehicle and to select at least one counter-signal parameter influencing the counter-signal, depending upon the physical size described through the detection information, from the storage device and to adapt at least one of the counter-signal parameters influencing the acoustic counter-signal, i.e. e.g. the phase of the counter-signal or the frequency of the counter-signal or a transfer path describing the phase and the frequency of the counter-signal or the counter-signal, depending upon the physical size described through the detection information, from a storage device, as well as to generate a counter-signal on the basis of the at least one selected counter-signal parameter and/or on the basis of the at least one adapted counter-signal parameter. The output unit is configured to output the generated counter-signal into the passenger compartment of the motor vehicle to suppress interfering signals, introduced into the passenger compartment of the motor vehicle, resulting from the operation of the on-board drive unit.

Essentially, all explanations in conjunction with the method apply analogously for the device. Thus, the device can be developed as follows:

The storage device can contain multiple acoustic counter-signal parameters. Acoustic counter-signal parameters respectively assigned to least one established physical size can be data-accordantly stored in the storage device.

The storage device can be configured to carry out the adaptation of the, in particular pre-selected, acoustic counter-signal parameter by means of an adaptation function selected depending upon the physical size described through the detection information.

The storage device can contain multiple adaptation functions. Adaptation functions assigned, respectively, to at least one established physical size, can be data-accordantly stored in the storage device.

The detection device can be configured to detect a course, temporally-dependent over an established time period, of the at least one physical size.

The detection device can further be configured to continuously or discontinuously detect the at least one physical size.

The control unit can be configured to select all counter-signal parameters influencing the counter-signal parameter, within the scope of the selection of the at least one counter-signal parameter influencing the acoustic counter-signal, so that a completely new acoustic counter-signal is selected and/or to adapt all counter signal parameters influencing the counter-signal parameter, within the scope of the adaptation of the at least one counter-signal parameter influencing the acoustic counter-signal, so that a complete acoustic counter-signal is adapted.

Moreover, the invention relates to a motor vehicle, i.e. in particular a passenger car. The motor vehicle includes at least one drive unit, e.g. in particular an electric motor and/or an internal combustion engine, wherein acoustic interference signals result, introduced into a passenger compartment of the motor vehicle, from the operation of the drive unit. The motor vehicle includes a device as described to suppress the interfering signals. Thus, all explanations in conjunction with the device and the method also apply analogously to the motor vehicle.

The invention is further described based on an exemplary embodiment in the illustration figures. Here, the single FIGURE shows a basic principle representation of a device according to an exemplary embodiment.

The device 1 shown in the Fig. is arranged or configured in a motor vehicle 2 indicated purely schematically, and is configured to suppress interfering signals 5, i.e. in particular vibrations, introduced into the passenger compartment 4 of the motor vehicle 2, resulting from the operation of the on-board drive unit 3, i.e. typically an electric motor and/or an internal combustion engine, by means of at least one artificially generated counter-signal 6, defined through at least one counter-signal parameter. Corresponding interfering signals 5 can be detected by means of the device 1 and on the basis of the detected interfering signals 5, counter-signals 6 can be artificially generated and output into the passenger compartment 4. The device 1, therefor, comprises a sensor 7, e.g. in the form of one or multiple microphone unit(s), to detect corresponding interfering signals 5 and an output unit 8, e.g. in the form of one or multiple loudspeaker units, for outputting corresponding counter-signals 6 into the passenger compartment 4, as functional components. The sensor 7 and the output device 8 are (data-accordantly) connected with a central control unit 9, implemented by hard and/or software, as further functional component of the device 1.

Further functional components of the device 1 include the detection device 10 and the storage device 11. The detection device 10 and the storage device 11 are likewise connected (data accordantly) with the control unit 9. The detection device 10 is configured, in the passenger compartment 4, to detect at least one physical size, i.e. e.g. the pressure or the moisture or the temperature and, to that end, includes suitable detection elements (not shown), i.e. e.g. pressure, moisture or temperature sensors. The storage device 11, if necessary configured as a look-up table, is configured to store data or information and, to that end, includes suitable data storage elements (not shown).

A method for suppressing (damping) of interfering signals 5, introduced into the passenger component 4, resulting from the operation of the drive unit 3, by means of artificially generated counter-signals 6, defined through at least one counter-signal parameter, can be implemented by means of the device 1 or through the cooperation of the described functional components of the device 1. The method, accordingly, makes the acoustic suppression or damping of corresponding interfering signals 5 through the targeted generation of artificial counter-signals 6 possible. The counter-signals 6 effect an, if necessary, complete suppression of the interfering signal 5, in particular on the basis of a phase reverse to the phase of the respective interfering signals 5.

In a first step of the method, at least one physical size, under which a value or value range of the respectively established physical size, i.e. e.g. a pressure, moisture, or temperature value is certainly also to be understood, is detected in the passenger compartment 4 by means of the detection device 10. The physical size can, as mentioned, e.g. relate to the pressure, the moisture or the temperature in the or inside the passenger compartment 4. The detection of respective physical sizes make a more or less complete representation of the detected physical, if necessary climatic conditions in the passenger compartment 4 possible, depending upon the number of detected physical sizes. The detection of the physical size(s) can occur continuously or discontinuously, and can also include a course, temporally-dependent over a certain time period, of a physical size.

In a second step of the method, a detection information describing the at least one physical size is generated, e.g. by means of the detection device 10. The physical size(s) or values detected by means of the detection device 10 are accordingly represented in a data accordantly (further) processable detection information.

In a third step of the method, at least one counter-signal parameter influencing the counter-signal 6 is selected, depending upon the physical size(s) described through the detection information, from the storage device 11. Multiple counter-signal parameters are therefore, data-accordantly stored in the storage device 11. Respective counter-signal parameters are stored linked with an established physical size or an established value or value range of a certain physical size. An established physical size or an established value or value range of an established physical size is accordingly assigned to respective counter-signal parameters. The selection of a corresponding counter-signal parameter occurs on the basis of the physical size described through the detection information, wherein a counter-signal parameter is selected, the assigned physical size of which or the assigned value of which corresponds to the physical size described through the detection information. To that end, suitable selection algorithms can be employed. The assignment of respective counter-signal parameters to respective physical sizes can result on the basis of assignment criteria gained from preliminary investigations, in which the influence of different physical parameters on the suppression of corresponding interfering signals 5, in the passenger compartment 4, was examined.

Via an adaptation function, EOC parameters or EOC tuning parameters, e.g. A (forgetting factor) or μ (step width), can also be adapted. In other words, an adaptation of EOC parameters or EOC tuning parameters can result by means of an adaptation function selected depending upon the physical size described through the detection information. The EOC parameters or EOC tuning parameters influence corresponding counter-signal parameters, an adaptation of counter-signal parameters can thus occur via an adaptation of EOC parameters or EOC tuning parameters.

Alternatively or additionally, at least one counter-signal parameter, in particular pre-selected, influencing the counter signal 6, is, in the third step of the method, adapted or changed depending upon the physical size described through the detection information. The adaptation of the counter-signal parameter occurs by means of an adaptation function or specification, i.e. an adaptation algorithm, selected depending on the physical size described through the detection information. The adaptation function can, e.g. contain an interpolation or an extrapolation of a respective counter-signal parameter with respect to an established target size. The selection of an adaptation function occurs depending upon the physical size described through the detection information. Multiple counter-signal parameters are stored data accordantly in the storage device 11. Respective adaptation functions are stored linked with an established physical size or an established physical value or value range of an established physical size. An established physical size or an established physical value or value range of an established physical size is accordingly assigned respective adaptation functions. The selection of a corresponding adaptation function occurs on the basis on the physical size described through the detection information, wherein an adaptation function, the assigned physical size of which or the assigned value of which corresponds to the physical size described through the detection information, is selected. To that end, suitable selection algorithms can, in turn, be employed. The assignment of respective adaptation functions to respective physical sizes can, in turn, result based on assignment criteria gained from corresponding preliminary inquiries, in which the influence of different physical parameters on the suppression of corresponding interfering signals, in the passenger compartment 4, was examined.

Corresponding counter-signal parameters can, e.g. relate to the phase of the counter-signal 6 or the frequency of the counter-signal 6 or a transfer path describing the phase and the frequency of the counter-signal 6 or the intensity of the counter-signal 6. The transfer path typically refers to the actual spatial arrangement of the sensor 7, indicated through the double arrow, for detecting a corresponding interfering signal 5 relative to the output unit 8 for outputting a corresponding counter-signal 6.

In a fourth step of the method, the counter-signal 6 is generated, in the control unit 9, on the basis of the selected counter-signal parameter and/or on the basis of the adapted counter-signal parameter. The generation of the counter-signal 6 or the acoustic features thereof rests or rest accordingly, on the one hand, on the interfering signal 5 to be suppressed, and, on the other hand, on the physical conditions in the passenger compartment 4 represented through respectively detected physical sizes.

In a fifth step of the method, the generated counter-signal 6 is output by means of the output unit 8 in the passenger compartment 4 to suppress corresponding interfering signals 5. As mentioned, the counter-signal 6 typically has a phase reverse to the interfering signal 5 to be suppressed.

Within the scope of the selection of the counter-signal parameter, all counter-signal parameters influencing the counter-signal 6 can certainly also be selected, so that a completely new counter-signal 6 is selected. Correspondingly, all counter-signal parameters influencing the counter-signal 6 can, within the scope of the adaptation of the counter-signal parameter, be adapted, so that a complete counter-signal 6 is adapted.

The invention claimed is:

1. Method for suppressing acoustic interfering signals, introduced into a passenger compartment of the motor vehicle, resulting from the operation of an on-board drive unit, by means of at least one artificially-generated acoustic counter-signal, defined through at least one counter-signal parameter, comprising the following steps:

detecting at least one physical size in the passenger compartment of the motor vehicle via one or more detection elements arranged or configured inside the passenger compartment of the motor vehicle, wherein the at least one physical size comprises climatic conditions in at least a part of the passenger compartment, generating at least one detection information describing the at least one detected physical size in the passenger compartment of the motor vehicle, selection of at least one counter-signal parameter influencing the acoustic counter-signal, depending upon the physical size described through the detection information, and/or adaptation of at least one counter-signal parameter influencing the acoustic counter-signal, depending upon the physical size described through the detection information, generating an acoustic counter-signal on the basis of the at least one selected counter-signal parameter and/or on the basis of the at least one adapted counter-signal parameter, and outputting the generated acoustic counter-signal into the passenger compartment of the motor vehicle to suppress acoustic interfering signals, introduced into the passenger compartment of the motor vehicle, resulting from the operation of the on-board drive unit.

2. Method according to claim 1, wherein the selection of an acoustic counter-signal parameter occurs from a storage device containing multiple acoustic counter-signal parameters, depending upon the physical size described through the detection information, wherein acoustic counter-signal parameters, respectively assigned to at least one established physical size, is stored data-accordantly in the storage device.

3. Method according to claim 1, wherein the adaptation of the, in particular pre-selected, acoustic counter-signal parameter occurs by means of a adaption function selected depending upon the physical size described through the detection information.

4. Method according to claim 3, wherein the selection of an adaptation function occurs from a storage device containing multiple adaptation functions, depending upon the physical size described through the detection information, wherein adaptation functions respectively assigned to at least one established physical size are stored data-accordantly in the storage device.

5. Method according to claim 1, wherein a pressure or a moisture or a temperature is detected as the at least one physical size inside the passenger compartment of the motor vehicle.

6. Method according to claim 1, wherein a course of the at least one physical size temporally-dependent over a certain time period is detected.

7. Method according to claim 1, wherein the at least one physical size in continuously or discontinuously detected.

8. Method according to claim 1, wherein the phase of the acoustic counter-signal, or the frequency of the acoustic counter-signal, or a transfer path describing the phase and the frequency of the acoustic counter-signal or the intensity of the acoustic counter-signal is used as the at least one parameter influencing the acoustic counter-signal.

9. Method according to claim 1, wherein all counter-signal parameters influencing the acoustic counter-signal are selected, within the scope of the selection of the at least one counter-signal parameter influencing the acoustic counter-signal, so that a completely new acoustic counter-signal is selected and/or so that all counter-signal parameters influencing the acoustic counter-signal are adapted, in the scope of the adaptation of the at least one counter-signal parameter influencing the acoustic counter-signal, so that a complete acoustic counter-signal is adapted.

10. Device for suppressing acoustic interfering signals, introduced into a passenger compartment of the motor vehicle, resulting from the operation of an on-board drive unit, by means of at least one artificially-generated acoustic counter-signal, defined through at least one counter-signal parameter, in particular according to the method according to claim 1, including a detection device, a control unit, a storage device and an output unit, wherein the detection device is configured to detect the at least one physical size in the passenger compartment of a motor vehicle, wherein the at least one physical size comprises climatic condition in at least a part of the passenger compartment, wherein the detection device comprises one or more detection elements arranged or configured inside a passenger compartment of the motor vehicle, the control unit is configured to generate at least one detection information describing the at least one detected physical size in the passenger compartment of the motor vehicle and to select at least one counter-signal parameter influencing the acoustic counter-signal from the storage device, depending upon the physical size described through the detection information, and/or to adapt at least one counter-signal parameter influencing the acoustic counter-signal from a storage device, depending on the physical size described through the detection information, as well as to generate an acoustic counter-signal, on the basis of the least one selected counter-signal parameter and/or on the basis of the at least one adapted counter-signal parameter, and the output device is configured to output the generated acoustic counter-signal into the passenger compartment of the motor vehicle to suppress acoustic interfering signals, introduced into the passenger compartment of the motor vehicle, resulting from the operation of the on-board drive unit.

11. Device according to claim 10, wherein the control unit contains multiple acoustic counter-signal parameters, wherein acoustic counter-signal parameters respectively assigned to at least one established physical size are stored data-accordantly in the storage device.

12. Device according to claim 10, wherein the control unit is configured to carry out the adaption of the in particular pre-selected acoustic counter-signal parameter by means of an adaptation function selected depending upon the physical size described through the detection information.

13. Device according to claim 12, wherein the storage device includes multiple adaption functions, wherein adaption functions respectively assigned to at least one established physical size are stored data-accordantly in the storage device.

14. Device according to claim 1, wherein the at least one physical size is a pressure or the moisture or the temperature inside the passenger compartment of the motor vehicle.

15. Device according to claim 10, wherein the detection device is configured to detect a course of the at least one physical size temporarily-dependent over a certain time period.

16. Device according to claim 10, wherein the detection device is configured to continuously or discontinuously detect the at least one physical size.

17. Device according to claim 10, wherein the at least one parameter influencing the acoustic counter signal is the phase of the acoustic counter signal of the frequency of the acoustic counter signal or a transfer path describing the phase and the frequency of the acoustic counter signal, or the intensity of the acoustic counter signal.

18. Device according to claim 10, wherein the control unit is configured to select all counter signal parameters influencing the acoustic counter signal in the scope of the selection of the at least one counter signal parameter influencing the acoustic counter signal, so that a completely new acoustic counter signal is selected, and/or to adapt all counter signal parameter influencing the acoustic counter signal in the scope of the adaption of the at least one counter signal parameter influencing the acoustic counter signal, so that a complete acoustic counter signal is adapted.

19. Motor vehicle, comprising at least one drive unit and a device according to claim 10, wherein acoustic interfering signals resulting from the operation of the drive unit introducible into the passenger compartment are compensatable or compensated by the device.

* * * * *